US009611651B2

(12) United States Patent
Eisenkrein

(10) Patent No.: US 9,611,651 B2
(45) Date of Patent: Apr. 4, 2017

(54) WALL CLADDING SYSTEM

(71) Applicant: Keith Richard Eisenkrein, Kelowna (CA)

(72) Inventor: Keith Richard Eisenkrein, Kelowna (CA)

( * ) Notice: Subject to any disclaimer, the term of this patent is extended or adjusted under 35 U.S.C. 154(b) by 0 days.

(21) Appl. No.: 14/754,486

(22) Filed: Jun. 29, 2015

(65) Prior Publication Data

US 2015/0300026 A1 Oct. 22, 2015

Related U.S. Application Data

(63) Continuation-in-part of application No. 13/787,661, filed on Mar. 6, 2013, now abandoned.

(60) Provisional application No. 61/607,407, filed on Mar. 6, 2012.

(51) Int. Cl.

| | |
|---|---|
| ***E04B 9/00*** | (2006.01) |
| ***E04F 13/04*** | (2006.01) |
| *E04B 1/76* | (2006.01) |

(52) U.S. Cl.

CPC ..... *E04F 13/047* (2013.01); *E04F 13/045* (2013.01); *E04B 1/762* (2013.01); *Y10T 428/24537* (2015.01); *Y10T 442/10* (2015.04)

(58) Field of Classification Search

CPC ..... E04B 1/762; E04B 2/723; E04B 2/707; E04F 13/04; E04F 13/045; E04F 13/047; E04F 13/02; E04C 2/296

USPC ..... 52/344, 346, 361–363, 446, 453, 454, 52/309.2

See application file for complete search history.

(56) References Cited

U.S. PATENT DOCUMENTS

| | | | | |
|---|---|---|---|---|
| 1,776,254 | A * | 9/1930 | Dozier | E04F 13/04 52/446 |
| 1,890,486 | A * | 12/1932 | Angier | E04B 2/56 52/346 |
| 5,410,852 | A * | 5/1995 | Edgar | E04B 1/765 52/408 |
| 5,493,837 | A * | 2/1996 | Hepler | E04C 2/296 52/363 |
| 5,979,131 | A | 11/1999 | Remmele et al. | |
| 6,355,333 | B1 * | 3/2002 | Waggoner | E04B 1/62 428/174 |
| 6,807,786 | B1 | 10/2004 | Peck | |
| 6,931,809 | B1 | 8/2005 | Brown et al. | |
| 7,625,827 | B2 | 12/2009 | Egan et al. | |
| 8,615,950 | B1 * | 12/2013 | Gomes | E04F 13/04 52/255 |

(Continued)

*Primary Examiner* — Brian Mattei

(74) *Attorney, Agent, or Firm* — Richard D. Okimaw

(57) ABSTRACT

A system and method for cladding a building. The system comprises a rigid base layer supported by an exterior exposed surface of the building and a metal mesh secured and retained in direct contact with an exterior surface of the rigid base layer with fasteners. The system further comprises a layer of a base coat applied over the metal mesh so as to form a matrix therearound and a finishing barrier layer applied over the matrix of the metal mesh and the base coat layer. The method comprises securing the rigid base layer to an exterior exposed surface of the building, securing and retaining a metal mesh in direct contact to the exterior surface of the rigid base layer with fasteners, applying a cement base coat over the metal mesh so as to form a matrix therearound and applying a finishing barrier layer over the base coat.

7 Claims, 5 Drawing Sheets

(56) References Cited

U.S. PATENT DOCUMENTS

| | | | | |
|---|---|---|---|---|
| 8,966,845 | B1 * | 3/2015 | Ciuperca | E04B 1/80 52/309.12 |
| 2006/0277854 | A1 * | 12/2006 | Egan | E04B 1/70 52/302.3 |
| 2007/0051069 | A1 * | 3/2007 | Grimes | E04B 1/7069 52/782.1 |
| 2008/0263971 | A1 * | 10/2008 | Maziarz | E04F 17/08 52/204.1 |
| 2011/0078971 | A1 * | 4/2011 | Adams | A01N 37/44 52/517 |
| 2011/0214374 | A1 | 9/2011 | Propst | |
| 2014/0087158 | A1 * | 3/2014 | Ciuperca | B32B 7/02 428/215 |

* cited by examiner

WALL CLADDING SYSTEM

CROSS REFERENCE TO RELATED APPLICATION

This application is a continuation in part application of U.S. patent application Ser. No. 13/787,661 filed Mar. 6, 2013 entitled Wall Cladding System which in turn claims priority to U.S. Provisional Patent Application No. 61/607,407 filed Mar. 6, 2012 entitled Wall Cladding System.

BACKGROUND OF THE INVENTION

1. Field of Invention

The present invention relates to wall cladding in general and in particular to a method and system for applying stucco to a building that is pest resistant.

2. Description of Related Art

Stucco is a common building cladding process. One common stucco method is called exterior insulation finishing system (EIFS). The EIFS system provides a layer of insulation, which commonly comprises expanded polystyrene foam applied to the exterior of the house as boards or panels. Thereafter, a reinforced layer consisting of a fiberglass reinforcing mesh embedded within a cementous adhesive is applied to the exterior of the foam panels which is then also covered with a final topcoat or finish.

Several difficulties presently exist with conventional EIFS systems. In particular, conventional EIFS systems may be prone to damage by pests, such as rodents, birds and the like. As the materials utilized in a conventional EIFS system are either soft (polystyrene foam) or brittle (acrylic or polymer coatings), many pest or animals are able to either chew or break apart such materials thereby creating a hole or cavity in the cladding. Such animals or pests are also commonly able to tear or otherwise remove the reinforcing fiberglass within the reinforcing layer thereby providing easy access to the interior of the polystyrene foam. Thereafter, such animals have been known to either build nests or gain access to the rest of the building causing significant damage as well as permitting water and other environmental elements to reach the wall interior.

Additionally, as the reinforcing layer of a conventional EIFS system is adhered directly to the wall boards, commonly, it is necessary to smooth the exterior surface of the wall panels to ensure a uniform surface for the cementous adhesive to be adhered to. Additionally, as the reinforcing layer is adhered to the foam panels by the cementous adhesive, it is often necessary to rough or otherwise prepare such surface of the wall panels so as to enable the cementous adhesive to adhere thereto. The step of preparing the surface of the foam wall panel is often accomplished by sanding or utilizing a rasp, as are commonly known. It will be appreciated that the step of sanding or rasping the surface of the foam panels, is both time consuming and messy thereby adding additional cost to the preparation and clean-up of a particular worksite.

SUMMARY OF THE INVENTION

According to a first embodiment of the present invention there is disclosed a system for cladding a building comprising a rigid base layer supported by an exterior exposed surface of the building and a metal mesh secured and retained in direct contact with an exterior surface of the rigid base layer with fasteners. The system further comprises a layer of a base coat applied over the metal mesh so as to form a matrix therearound and a finishing barrier layer applied over the matrix of the metal mesh and the base coat layer.

The system may further comprise a rigid base layer applied to the building exterior below the metal mesh wherein the metal mesh is secured to the base layer. The base layer may be formed of an insulating material. The insulating material may comprise expanded polystyrene.

The base coat may be formed of a material selected from the group consisting of cement, plaster or polymers. The finishing barrier layer may be formed of an acrylic. The metal mesh may be secured to the exterior surface of building by fasteners. The metal mesh may be secured to the base layer by fasteners. The metal mesh may be substantially planar.

The base layer may include a groove formed therein, wherein the system further includes a shaped metal mesh strip having a profile corresponding to the groove, the shaped metal mesh strip being securable within the groove wherein the base coat and the barrier layer are applied thereover in a substantially uniform thickness so as to form a corresponding groove in a finished wall.

According to a first embodiment of the present invention there is disclosed a method for cladding a building comprising securing a rigid base layer to an exterior exposed surface of the building and securing and retaining a metal mesh in direct contact to an exterior surface of the rigid base layer with fasteners. The method further comprises applying a cement base coat over the metal mesh so as to form a matrix therearound and applying a finishing barrier layer over the base coat.

The method further may comprise securing a base layer to the building exterior wherein the metal mesh is secured to the base layer. The metal mesh may be secured to the base layer with fasteners.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
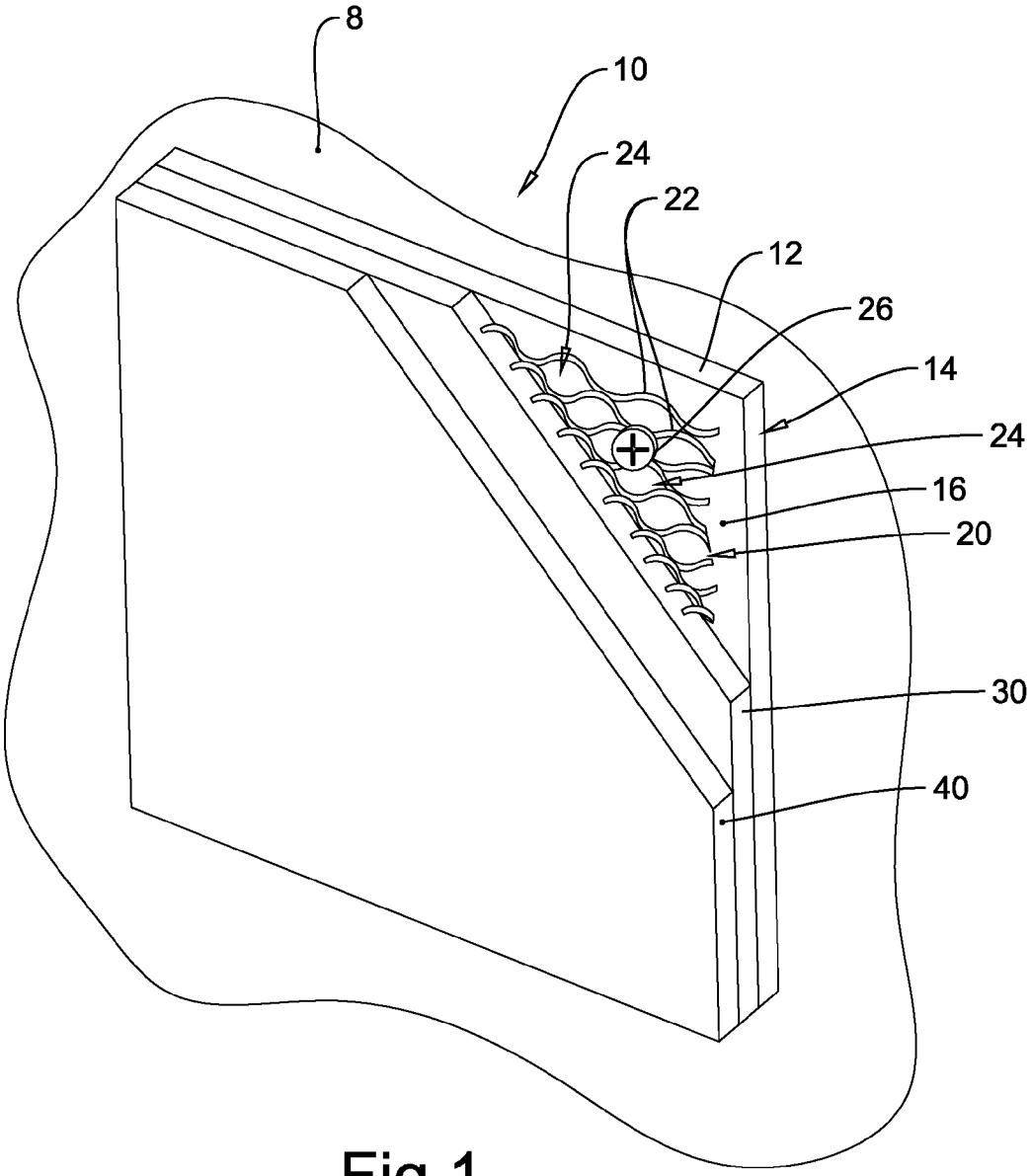
FIG. 1 is a perspective view of a wall cladding system according to a first embodiment of the present invention.

Referring to FIG. 1, a wall cladding assembly is illustrated generally at 10 as applied to a wall sheathing 8. The wall sheathing 8 may be of any conventional type, such as, by way of non-limiting example, plywood, masonry, concrete, lumber or wall studs. The assembly 10 comprises a layer of an insulating material 12 having a metal mesh layer 20 secured thereover. The assembly further includes a base matrix layer 30 applied around the metal mesh and a top coat layer 40 applied thereover.

The insulating material 12 may comprise a plurality of substantially planar insulating panels (only one shown in FIGS. 1 and 2) located side by side so as to form a continuous planar barrier. The insulating material 12 has front and rear surfaces, 16 and 14, respectively. The insulating material may be formed of any suitable material, such as, by way of non-limiting example, expanded polystyrene, wall board, plywood or the like. The rear surface 14 of the insulating panels may be secured to the wall sheathing 8 by fasteners, adhesives or the like as is commonly known in the art.

The metal mesh 20 comprises a semi-permeable member formed of a plurality of elongate metal members 22 having bores or cavities 24 therethrough. The metal members 22 are connected to each other to form a continuous perforated member. As illustrated, the metal mesh 20 may be formed of an expanded metal mesh, although it will be appreciated that any other metal mesh type may be useful as well, such as, by way of non-limiting example woven, knitted, welded, photo-chemically etched or electroformed (screen filter) from steel, stainless steel, aluminium, copper or any other metals. In particular, it has been found that a wire mesh having cavities 24 therethrough of up to 2 inches (51 mm) therethrough may be particularly useful although it will be appreciated that many other types and sizes of wire mesh may be useful as well.

Figure 2:
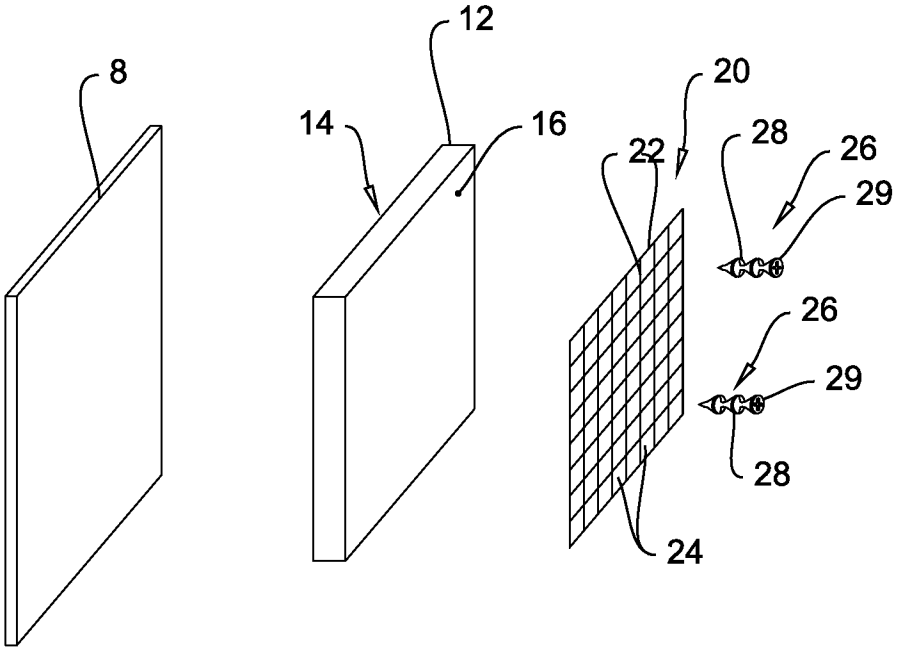
FIG. 2 is an exploded perspective view the assembly of a portion of the wall cladding system of FIG. 1.

With reference to FIG. 2, the metal mesh 20 is secured to the front surface 16 of the insulating material 12 by fasteners 26. The fasteners 26 include a threaded portion 28 sized to be passed through the cavities 24 of the metal mesh and a head portion 29 sized to overlap at least one metal member 22 such that when the fastener 26 is passed through the cavities 24 of the metal mesh the head portions 29 will bear against the metal mesh 20 and bias the metal mesh into direct contact with the front surface 16 of the insulating layer. It will be appreciated that any suitable fastener may be utilized, although it has been found that EZ Anchors® manufactured by Buildex® are particularly useful.

After the metal mesh 20 has been secured to the front surface of the insulating material 12, a base coat of a matrix material 30 is applied thereover so as to surround and encase the metal mesh therein while retaining the metal mesh in contact with the front surface of the insulating material 12. The matrix material 30 may be selected from any conventionally known base layer, such as, by way of non-limiting example, cement or polymers. The matrix material 30 is applied to the insulating material 12 and mesh 20 by a trowel or sprayed on in a conventional manner. The matrix material 30 may be applied in any desired thickness so as to completely cover the metal mesh 20, such as by way of non-limiting example between ⅛ and ¼ inches (3 and 6 mm).

It will be appreciated that although the matrix material 30 is applied to the insulating material 12, it is not required to be completely adhered to the front surface 16 of the insulating material. Rather a portion of the weight of the matrix material 30 will be supported by the metal mesh 20 which is fixedly secured to the insulating material. Therefore it will be appreciated that the additional step of rasping or sanding of the insulating material may not be necessary.

After the matrix material 30 is allowed to dry for a sufficient length of time, such as, by way of non-limiting example at approximately 24 to 48 hours as is commonly known in the art, the top coat 40 is applied thereto. The top coat 40 comprises a finished color selected layer which is weatherproof so as to prevent the inclusion of weather and other elements into the assembly. The top coat 40 is commonly selected from any suitable material, such as, by way of non-limiting example, acrylic and is commonly applied by a trowel or sprayed on according to known methods. The top coat 40 may have any thickness desired depending upon the use, although it will commonly have a thickness of approximately ⅛ inches (3 mm).

In use, the present assembly will prevent the penetration of pests such as rodents and birds by providing a metal mesh layer which the pests are unable to penetrate. Therefore, although the birds and rodents may be able to penetrate the outer layers of the assembly they will not pass all the way through into the insulating layer where they would be able to build a nest or cause other further damage. Therefore, the amount of repair necessary to fix to such superficial damages will be significantly reduced.

Figure 3:
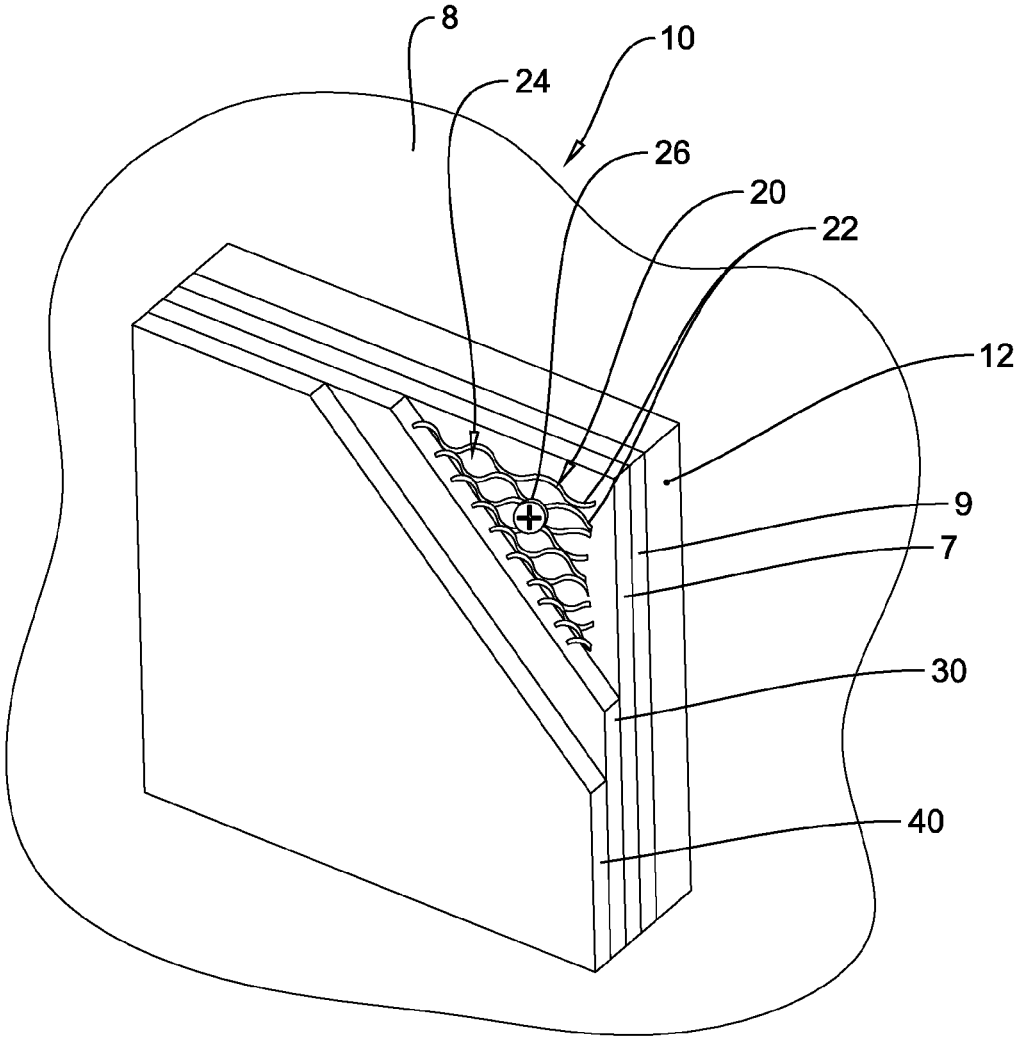
FIG. 3 is a perspective view of a wall cladding system according to a further embodiment of the present invention applied to an existing stucco wall.
Figure 5:
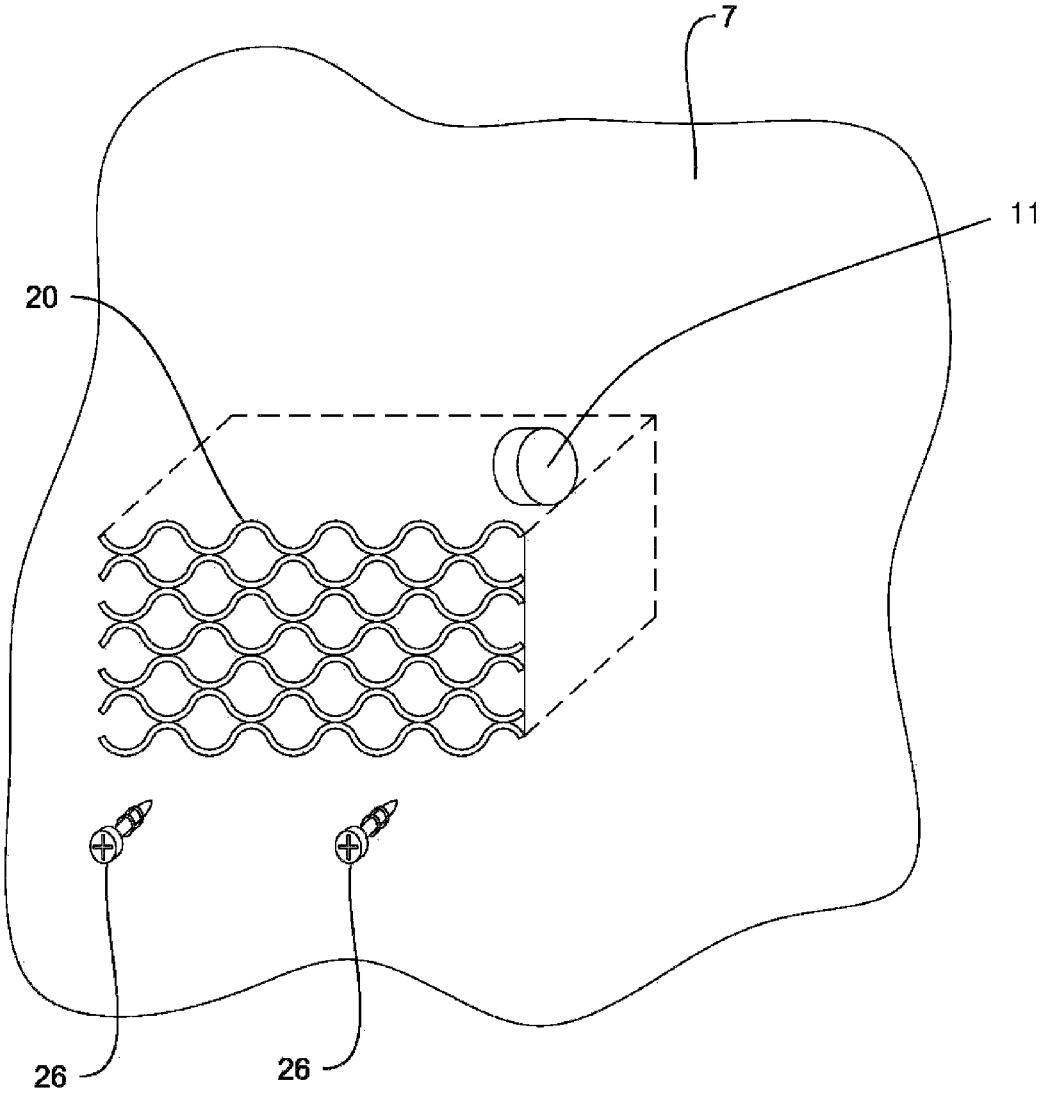
FIG. 5 is an exploded view of a mesh being applied over a hole in a wall according to a further embodiment of the present invention for wall repairs.

Turning now to FIGS. 3 and 5, according to a further embodiment of the present invention the present assembly 10 may be applied to an existing stucco or other wall type as illustrated. The pre-existing wall may be formed of a layer of an insulating material 12 having a matrix layer 9 applied thereover and an outer top coat layer 7 as is commonly known. The assembly 10 of the present invention may be applied over such a pre-existing EIFS stucco wall by applying a metal mesh layer 20 thereover having a base matrix layer 30 applied around the metal mesh and a top coat layer 40 applied thereover. In such a manner, damage, such as hole generally indicated at 11 in FIG. 5 to existing EIFS stucco walls may be repaired without requiring the complete removal of the pre-existing EIFS stucco.

Figure 4:
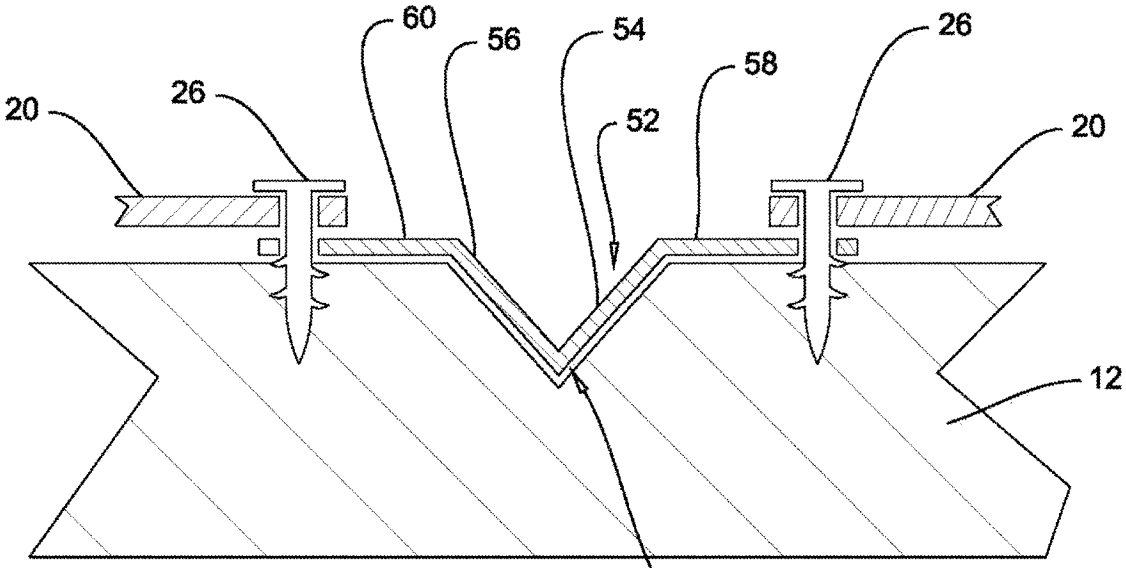
FIG. 4 is a cross-sectional view of a v-groove having the present system therein.

With reference to FIG. 4, the assembly 10 may be applied to v-grooves 50 as illustrated. The assembly may include a shaped mesh 52 having first and second side panels 54 and 56 and with first and second flanges 58 and 60, extending therefrom. The shaped mesh 52 may be formed of a substantially similar mesh material as metal mesh 20 as described above. The shaped mesh 52 may be bent, or otherwise formed into the desired shape to correspond to the v-groove in the insulating material 12. Once applied to the v-groove, adjacent metal meshes 20 may be overlapped thereon and both the metal mesh 20 and shaped mesh 52 secured to the insulating material 12 by fasteners 26. It will also be appreciated that similar shaped meshes may be utilized to form interior and exterior corners as well as curves and other shaped in the finished wall.

While specific embodiments of the invention have been described and illustrated, such embodiments should be considered illustrative of the invention only and not as limiting the invention as construed in accordance with the accompanying claims.

What is claimed is:

1. A system for cladding a building comprising:

a rigid insulating base layer comprising expanded polystyrene supported by an exterior exposed surface of said building;

a metal mesh applied over said rigid insulating base layer;

a plurality of fasteners adapted to be passed through and bear said metal mesh against said exterior surface of said rigid insulating base layer, said fasteners being selected to penetrate and terminate within said rigid insulating base layer;

a layer of a base coat applied over said metal mesh so as to form a matrix therearound; and a finishing barrier layer applied over said matrix of said metal mesh and said base coat layer.

2. The system of claim 1 wherein said base coat is formed of a material selected from the group consisting of cement, and or polymers.

3. The system of claim 1 wherein said finishing barrier layer is formed of an acrylic.

4. The system of claim 1 wherein said metal mesh is substantially planar.

5. A method for cladding a building comprising:

securing a rigid insulating base layer comprising expanded polystyrene to an exterior exposed surface of the building;

applying a metal mesh in direct contact to an exterior surface of said rigid base layer;

passing a plurality of fasteners through said metal mesh into said rigid insulating base layer so as to terminate therein and so as to bear said metal mesh against said exterior surface of said rigid base layer;

applying a cement base coat over the metal mesh so as to form a matrix therearound; and applying a finishing barrier layer over the base coat.

6. The method of claim 5 wherein said finishing barrier layer is formed of an acrylic.

7. The method of claim 5 wherein said metal mesh is substantially planar.

* * * * *